US005365847A

United States Patent [19]

Pers

[11] Patent Number: 5,365,847

[45] Date of Patent: Nov. 22, 1994

[54] CONTROL SYSTEM FOR A PRINTING PRESS

[75] Inventor: William F. Pers, Hinsdale, Ill.

[73] Assignee: Rockwell International Corporation, El Segundo, Calif.

[21] Appl. No.: 125,622

[22] Filed: Sep. 22, 1993

[51] Int. Cl.[5] ..... B41F 13/24

[52] U.S. Cl. ..... 101/248; 101/228; 101/DIG. 45; 101/486; 101/450.1; 101/212; 101/216; 364/469; 346/153.1

[58] Field of Search ..... 101/212, 219, 228, 248, 101/181, 182, 211, 212, 138, 450.1, 468, 471, 472, 484, 486, 487, 488, DIG. 45; 358/440, 451, 456, 459; 364/469; 346/153.1

[56] References Cited

U.S. PATENT DOCUMENTS

| | | | |
|---|---|---|---|
| 4,003,660 | 1/1977 | Christie, Jr. et al. | 356/178 |
| 4,264,957 | 4/1981 | Pautzke | 101/248 |
| 4,297,716 | 10/1981 | Hirayama et al. | 346/153.1 |
| 4,401,024 | 8/1983 | Frentress | 101/248 |
| 4,485,982 | 12/1984 | St. John et al. | 226/10 |
| 4,541,336 | 9/1985 | Bernauer | 101/181 |
| 4,553,478 | 11/1985 | Greiner et al. | 101/248 |
| 4,677,298 | 6/1987 | Zelmanovic | 101/DIG. 45 |
| 4,718,340 | 7/1988 | Love, III | 101/450.1 |
| 4,719,575 | 1/1988 | Gnuechter | 101/248 |
| 4,789,820 | 12/1988 | Parrent, Jr. et al. | 324/58.5 R |
| 4,794,421 | 12/1988 | Stoudt et al. | 355/4 |
| 4,835,720 | 5/1989 | Ditto et al. | 364/561 |
| 4,847,775 | 7/1989 | Roch et al. | 364/469 |
| 4,852,485 | 8/1989 | Brunner | 101/DIG. 45 |
| 4,881,182 | 11/1989 | Hawk et al. | 101/DIG. 45 |
| 4,885,785 | 12/1989 | Reynolds et al. | 250/571 |
| 4,887,530 | 12/1989 | Sainio | 101/486 |
| 4,966,075 | 10/1990 | Brian | 101/228 |
| 4,972,774 | 11/1990 | MacPhee | 101/450.1 |
| 5,113,252 | 5/1992 | Horie et al. | 358/451 |
| 5,136,316 | 8/1992 | Punater et al. | 346/153.1 |
| 5,178,063 | 1/1993 | Wolfberg et al. | 101/226 |
| 5,181,257 | 1/1993 | Steiner et al. | 101/248 |
| 5,224,640 | 7/1993 | Fokos et al. | 101/248 |
| 5,255,085 | 10/1993 | Spence | 358/455 |

FOREIGN PATENT DOCUMENTS

| | | | |
|---|---|---|---|
| 0092743 | 11/1983 | European Pat. Off. | 101/228 |
| 0321402 | 6/1989 | European Pat. Off. | 101/DIG. 42 |
| 2024457 | 1/1980 | United Kingdom | 101/248 |

*Primary Examiner*—Eugene H. Eickholt
*Attorney, Agent, or Firm*—C. B. Patti; H. F. Hamann

[57] ABSTRACT

A control system (14) for a printing press (12) having a printing cylinder (**36*a*–36*d*) having an outer surface, a device (90) for determining a reference printing image for the outer surface of the cylinder (36*a*–36*d*), and a device (90) for modifying the reference printing image to a subsequent printing image, and a device (90, 45, 46, 48, and 50) for forming the subsequent printing image on the outer surface of the cylinder (36*a*–36*d***).

13 Claims, 3 Drawing Sheets

36a
Cylinder
36b
Cylinder
36c
Cylinder
36d
Cylinder
45
46
48
50
EID 1
EID 2
EID 3
EID 4
51
Sensor 1
52
Sensor 2
54
Sensor 3
56
Sensor 4
70
Page Area Reader (PAR)
CPU
Speed Sensor
60
58
Temperature and Humidity Device
78
Hard Copy
76
Type Setter
74
Pre Press
72
90
14
Sensor 5(C)
84
Sensor 6(M)
84
Sensor 7(K)
84
80
Tension Determining Device
64
EID=Electronic Imaging Device

CONTROL SYSTEM FOR A PRINTING PRESS

BACKGROUND OF THE INVENTION

The present invention relates to control systems for a printing press.

In the past, printing presses have utilized plate cylinders in conjunction with blanket cylinders to form a printed image on a moving web of paper. Such presses have required plates to be prepared containing the image, and such plates have been secured directly on the outer surface of the plate cylinders by suitable locking mechanisms in order to transfer the image from the plates to the blanket cylinders.

More recently, the images for printing have been directly formed, such as by electronic imaging, on the outer surface of a printing cylinder which is utilized in conjunction with the blanket cylinder in order to transfer the image from the printing cylinders to the blanket cylinders for printing the image on the web. However, some difficulties have been encountered with this process, such as misregistration between separate printing cylinders, possible fan-out of the web when the ink is placed on the web, and dot gain in the image. There has not yet been a satisfactory procedure for eliminating this result in the case where the images are directly formed on the printing cylinders.

SUMMARY OF THE INVENTION

A principal feature of the present invention is the provision of an improved control system for a printing press.

The control system of the present invention comprises, a printing cylinder having an outer surface, and means for determining a reference printing image for the cylinder.

A feature of the present invention is the provision of means for modifying the reference printing image to a subsequent printing image for the outer surface of the printing cylinder, dependent upon parameters associated with the press.

Yet another feature of the present invention is the provision of means for forming the modified subsequent printing image on the outer surface of the printing cylinder.

Yet another feature of the invention is that the press may have a first printing cylinder having a printing image and a plurality of subsequent downstream printing cylinders in which the additional printing cylinders have their image modified relative to the image on the first printing cylinder as a reference.

A further feature of the invention is that the system may determine misregistration between the printing cylinders, and the reference printing image is modified to the subsequent printing image responsive to the determination of the misregistration.

Yet another feature of the invention is that the parameters associated with the press may be determined, and the system uses this information to modify the reference printing image to the subsequent printing image.

A further feature of the invention is that the parameters may include the ambient temperature and humidity surrounding the press, the type of ink used, a substrate, such as the type of paper web utilized in the press, and dot gain.

Another feature of the invention is that the system may determine the condition of possible fan-out of the web which takes place after placement of the ink on the web.

Still another feature of the invention is that the system may modify the reference printing image to the subsequent printing image responsive to the determination of fan-out of the web.

Yet another feature of the invention is that the reference printing image may be changed to the subsequent printing image responsive to the speed of the press.

A further feature of the invention is that the reference printing image may be modified to the subsequent printing image responsive to tension of the web in the press.

Yet another feature of the invention is that the density of the desired ink and water placed at various locations on the printing cylinders may be determined by the system.

A further feature of the invention is that the reference printing image may be modified to the subsequent printing image responsive to the determination of densities for the ink and water.

Another feature of the invention is that the press produces an improved quality printed web responsive to modification of the reference printing image to the subsequent printing image by the control system of the present invention.

A further feature of the invention is that the reference printing image may be modified to the subsequent printing image in an efficient and simplified manner.

Still another feature of the invention is that the system automatically modifies the reference printing image to the subsequent printing image with minimal effort by an operator of the press.

Another feature of the invention is that the reference printing image may be formed in a computer, and may be modified to the subsequent printing image by the computer.

Yet another feature of the invention is that the reference printing image may be formed on the cylinder, and may be modified on the cylinder.

Further features will become more fully apparent in the following description of the embodiments of this invention, and from the appended claims.

DESCRIPTION OF THE PREFERRED EMBODIMENTS

Figure 1:
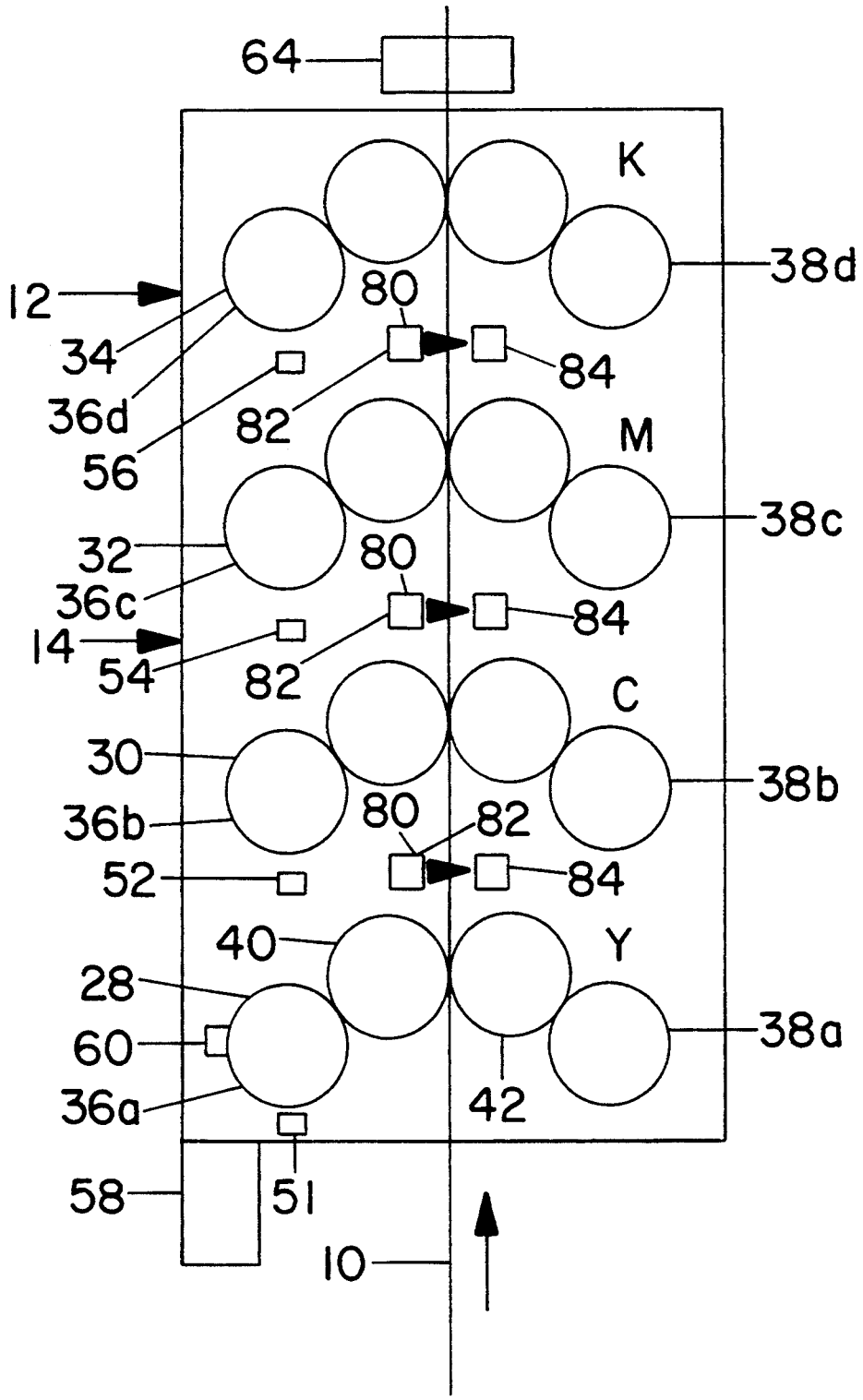
FIG. 1 is a diagrammatic view of a control system for a printing press of the present invention.

Referring now to FIG. 1, there is shown a paper web 10 for a printing press 12 having a control system generally designated 14 for controlling the web 10 in the press 12. The printing press 12 may have a plurality of printing units 28, 30, 32, and 34 with each having a different color of ink, such as Cyan C, Magenta M, Yellow Y, and Black K. Each of the printing units may have a pair of printing cylinders 36 and 38 on opposed sides of the web 10 which transfer an ink image to associated blanket cylinders 40 and 42 on opposed sides of the web 10, which in turn places the ink image onto the web 10 during printing by the press 12. The system 14 may have a suitable sensor or transducer 60 associated with a drive shaft or cylinder for the press 12 to determine the speed of the press 12.

Figure 2:
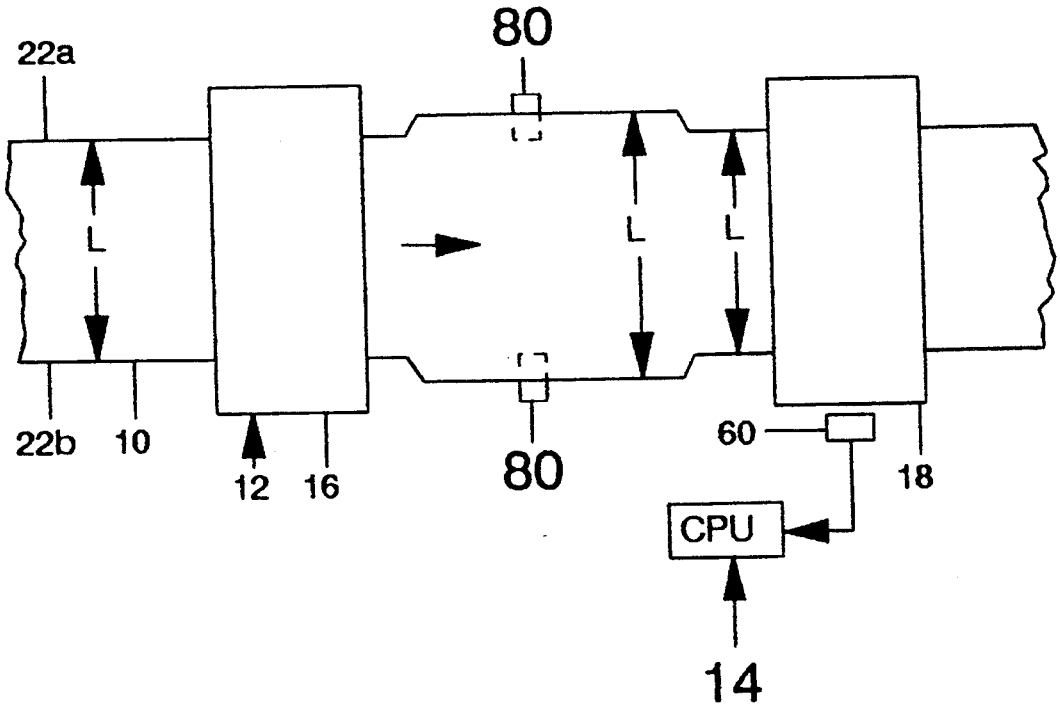
FIG. 2 is a diagrammatic plan view of the control system for the printing press of the present invention.

With reference to FIG. 2, the web 10 usually has a width L as it is removed from a roll for passage through the press 12. However, in the presence of moisture, such as ink or other fluids being placed on the web 10, such as by cylinders 16 and 18 in the multi-color printing units of the press 12, the moisture is absorbed by the web 10, and the web 10 laterally expands to dimensions L' which may cause distortion of the image on the web 10. Other factors which may cause fanning out of the web 10 between the lateral dimensions L and L' are paper formulation, stretch, printing compression, ink formulation, tension, and dampening fluid.

With reference to FIGS. 1 and 2, the system 14 has a pair of sensing assemblies 80 located adjacent to the opposed side edges 22*a* and 22*b* of the web 10. Each of the sensor assemblies 80 has a light emitter 82 which directs light toward the associated sensor 84 with the emitter 82 and sensor 84 being located on opposed sides of the web 10.

Figure 3:
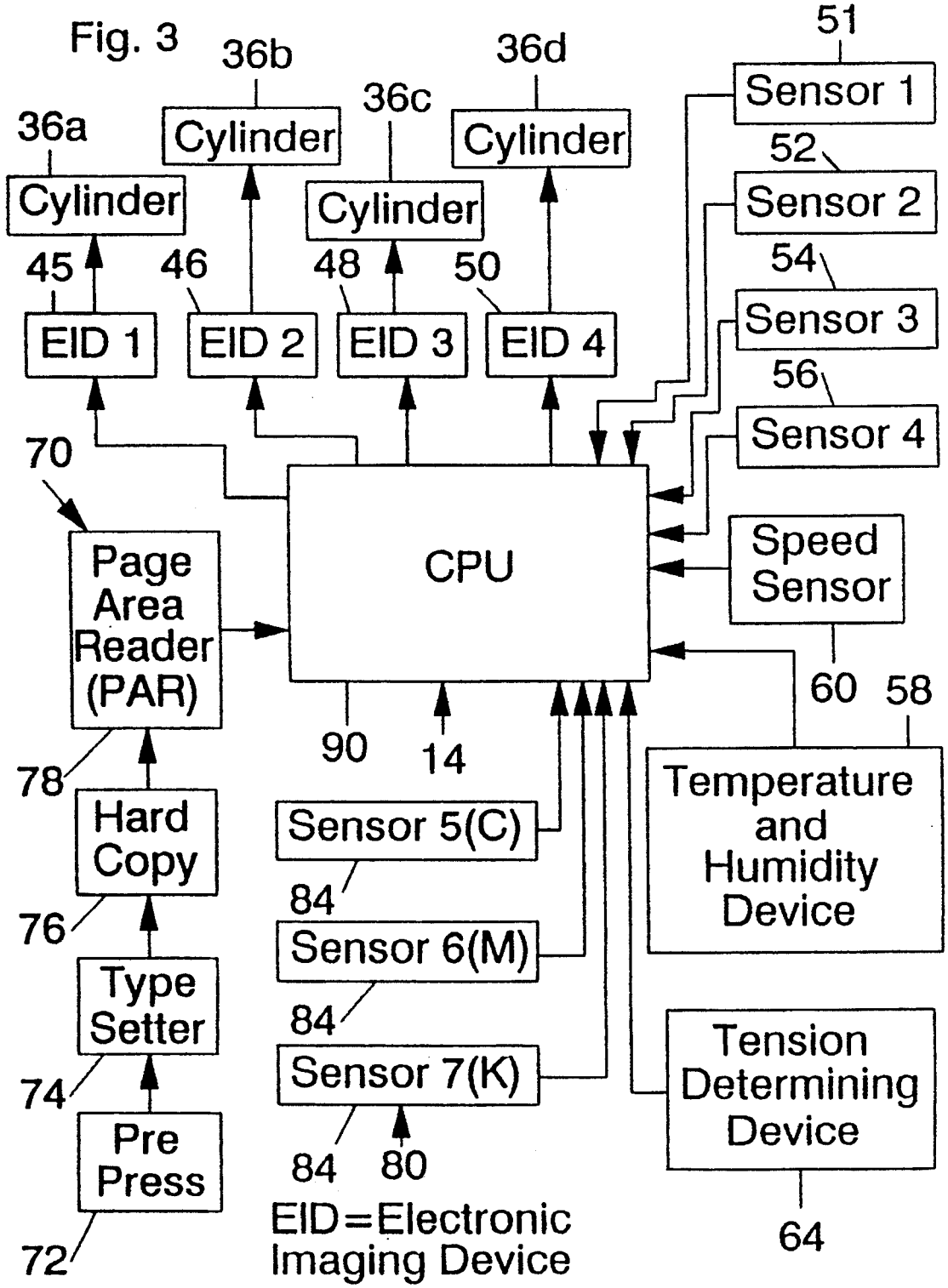
FIG. 3 is a block diagram of the control system for the printing press of the present invention.

With reference to FIG. 3, the control system 14 has a computer 90 or Central Processing Unit (CPU) having a Random Access Memory (RAM), and a Read Only Memory (ROM).

With reference to FIGS. 1 and 2, when the edge of the web 10 interrupts the light beam to the sensor 84, a signal is transmitted to the CPU in order to indicate a fan-out condition of the web such as due to moisture applied to the web 10, as previously discussed. Under this condition, either one or both side edges of the web 10 may interrupt either one or both of the sensors 80. In an alternative form, data concerning the fan-out condition of the web 10 may be placed in a look-up table in the memory of the computer 90 or CPU concerning the types of ink and paper being utilized in association with the expected fan-out of the web 10 during printing on the press 12 due to these conditions.

With reference to FIG. 3, the CPU is connected to and controls a plurality of Electronic Imaging Devices (EID) 45, 46, 48, and 50. The electronic image device 45 is connected to the cylinder 36*a* of the printing unit 28 associated with the color cyan C. The electronic image device 46 is connected to the printing cylinder 36*b* of the printing unit 30 associated with the color magenta M. The electronic image device 48 is connected to the printing cylinder 36*c* of the printing unit 32 associated with the color Yellow Y. The electronic image device 50 is connected to the printing cylinder 36*d* of the printing unit 34 associated with the color black K. Of course, suitable electronic image devices are connected to the printing cylinders 38*a–d* of the printing units in a similar manner on the opposed side of the web 10. Further discussion concerning the printing cylinders 36*a–d* will also apply to the printing cylinders 38*a–d* on the opposed side of the web 10. In one form, a reference image is formed in the CPU, and the reference image in the computer is modified to a subsequent image in the CPU dependent upon parameters associated with the press 12, such as fan-out, after which the electronic image devices 45, 46, 48, and 50 form the subsequent images on the printing cylinders 36*a–d* responsive to operation of the CPU. In an alternate form, the electronic image devices 45, 46, 48, and 50 may form the reference printing image directly on the outer surface of the printing cylinders 36*a–d* in the printing unit 28, 30, 32, and 34 responsive to control by the CPU, after which the reference image is modified to form the subsequent image responsive to control by the CPU directly on the printing cylinders 36*a–d*. Although the reference image and modified subsequent image may be placed on all of the printing cylinders 36*a–d*, it is preferred to only modify the downstream cylinders 36*b–d* relative to the printing cylinder 36*a*, and the upstream cylinder 36*a* may be used as a reference for the remaining printing cylinders 36*b–d*, such that the first printing cylinder 36*a* need not be changed when the images on the printing cylinders 36*b–d* are modified.

The printing images formed on the printing cylinders 36*a–d* are transferred during operation of the press 12 to the associated blanket cylinder 40 of the printing units 28, 30, 32, and 34 in order to form a printed image on the web 10. However, the subsequent printed or printing image on the outer surface of the printing cylinders 36*b–d* (and possibly 36*a*) in the printing unit 30, 32, and 34, (and possibly 28) is formed by the CPU through the electronic image devices 46, 48, and 50 (and possibly 45) to the subsequent printing image on the outer surface of the printing cylinders 36*b–d*. As shown, the CPU or computer 90 is connected to the electronic imaging devices 45, 46, 48, and 50 in order to form the desired subsequent printing images on the outer surface of the printing cylinders 36*a–d* in the printing units 28, 30, 32, and 34.

With reference to FIGS. 1–3, the CPU receives signals from the sensor assemblies 80 (sensor 5, sensor 6, sensor 7 and sensor 8) having the light emitters 82 and sensors 84, and determines whether a fan-out condition exists by the web 10 in the press 12, and, if so, the CPU sends appropriate signals to the associated electronic image devices 45, 46, 48, and 50 in order to modify the reference image on the printing cylinders 36*a–d* to the subsequent printing image, thus correcting the images responsive to the fan-out condition in order to obtain proper printing of the images on the web 10 by the printing cylinders 36*a–d* and associated blanket cylinders 40. In an alternative form, information concerning the fan-out condition may be stored in the memory of the computer 90, and the reference printing image in the CPU may be corrected to the subsequent printing image in the CPU without need for the use of the sensor assemblies 80 through use of data associated with the inks and web 10.

With reference to FIGS. 1 and 3, the control system 14 may have a plurality of sensors 51, 52, 54, and 56 (sensor 1, sensor 2, sensor 3, and sensor 4) associated with the printing cylinders 36*a–d* of the printing units 28, 30, 32, and 34 in order to determine misregistration of the reference images formed on the outer surface of the printing cylinders 36 concerning a downstream printing cylinder relative to an upstream cylinder or cylinders, such as the reference cylinder 36*a*. Thus, the sensors 51, 52, 54, and 56 determine the proper registration for each printing cylinder 36*b–d* relative to an upstream printing cylinder, and supply this information to the CPU. Of course, the printing cylinder 36*a* of the printing unit 28 may be utilized as a reference relative to the remaining printing cylinders 36*b–d* of the printing units 30, 32, and 34, and the printed image on the printing cylinder 36*a* of the printing unit 28 need not be changed as discussed above.

The CPU then determines from the signals of the sensor 52, 54, and 56 the amount of misregistration of the printing cylinders 36*b–d* in the printing units 30, 32, and 34, and then corrects or modifies the reference printing image either in the CPU or on the cylinders 36*b–d* to the subsequent printing image on the outer surface of the printing cylinders 36*b–d* by supplying appropriate signals to the electronic image devices 46, 48, and 50 associated with the printing cylinders 36*b–d* of the printing units 30, 32, and 34. In this manner, the reference printing image in the CPU or on the printing cylinder 36*b–d* of the printing units 30, 32, and 34 may be modified to the subsequent printing image on the printing cylinders 36*b–d* in order to obtain proper registration between the printing cylinders 36*b–d* and the associated blanket cylinders 40. Of course, suitable sensors may be utilized in conjunction with the printing cylinders 38*a–d* on the opposed side of the web 10 in order to obtain registration in a manner as previously described in connection with the printing cylinders 36*a–d*.

In addition, information related to parameters associated with the press 12 may be stored in suitable look-up tables in the memory of the computer 90 or CPU. Such parameters may include a substrate, such as the type of paper being used as a web 10, the type of inks, the ambient conditions surrounding the press 12, such as temperature and humidity which may be determined by a suitable temperature and humidity device 58 shown in FIG. 3, with the temperature and humidifying device being connected to the CPU. The information concerning the paper and ink may be such as the type and quality of the web 10 and inks utilized during a press run on the press 12.

In addition, the control system 14 may have a speed sensor 60, as shown in FIGS. 1–3, associated with a suitable drive shaft or rotating cylinder in the press 12. In this manner, the sensor 60 determines the speed of the press 12, and supplies this information to the CPU. In turn, the CPU determines from suitable information in the look-up table in the memory of the computer 90 any modifications or corrections which should be made to the reference image in the CPU or on the printing cylinders 36*a–d* of the printing units 28, 30, 32, and 34, and the CPU supplies this information to the associated electronic image devices 45, 46, 48, and 50 in order to form the subsequent printing image, and thus correct the images dependant on the speed of the press 12.

With reference to FIG. 3, the control system 14 may have a pre-press device generally designated 70 having a pre-press unit 72 in order to form page layouts which are of the type previously utilized in conjunction with plates for plate cylinders. The pre-press 72 supplies information to a typesetter 74 which is connected to a hard-copy device 76 which forms suitable hard copies, plates, or negatives for use in conjunction with the press 12. The image produced by the hard-copy device 76 may be read by a Page Area Reader (PAR) 78 which determines the relative densities of ink and water desired on the outer surface of the printing cylinders 36*a–d* in the printing units 28, 30, 32, and 34, or at the very least the printing units 30, 32, and 34. The Page Area Reader is connected to the CPU or computer 90, and supplies the density information to the computer 90 for processing. In turn, the computer 90 uses the information to modify the reference image in the CPU or supplies the information concerning the densities of ink and water to the associated electronic image devices 45, 46, 48, and 50 in order to form the proper subsequent images on the outer surface of the respective printing cylinders 36*a–d*, or to modify the reference printing images in the CPU or on the outer surface of the printing cylinders 36*a–d* to the subsequent printing image on the outer surface of the printing cylinders 36*a–d*.

In addition, as shown in FIGS. 1 and 3, the press 12 may have a device 64 for determining tension in the web 10 in a manner as known to the art. The tension determining device 64 supplies a signal to the CPU in order to indicate the tension on the web 10 in the press 12, and the computer 90 or CPU determines appropriate modifications to the printing reference image in the CPU or on the outer surface of the printing cylinders 36*a–d*, and supplies this information to the electronic imaging devices 45, 46, 48, and 50 in order to form the subsequent printing image on the outer surface of the printing cylinders 36*a–d*.

Further, the reference image in the CPU or on the cylinders 36*a–d* may be modified to compensate for dot gain of the image, i.e,, the increase or change of dot size during processing of the printing images. In this manner, the CPU may modify the size of the printing dots to form the desired size of dots on the outer surface of the cylinders 36*a–d*.

Thus, in accordance with the present invention, the control system 14 forms or modifies a printing image directly in the CPU or on the outer surface of the printing cylinders 36*a–d* of the various printing units in the press 12. The modified subsequent images are determined responsive to various conditions in the press, such as misregistration, parameters such as ambient conditions and types of materials, and densities of images formed for printing on the web 10. The control system 14 automatically provides this information for forming the images on the outer surface of the printing cylinders 36 with minimal intervention by an operator of the press. The control system 14 of the present invention forms the images in an efficient and rapid manner in order to improve the quality of the printed web 10 in the press 12.

The foregoing detailed description has been given :for clearness of understanding only, and no unnecessary limitations should be understood therefrom, as modifications will be obvious to those skilled in the art.

What is claimed is:

1. A control system for a printing press, comprising:

a printing cylinder having an outer surface;

means for determining a reference printing image for the cylinder;

means for modifying the reference printing image to a subsequent printing image dependent upon parameters associated with the press; and means for forming the subsequent printing image on the outer surface of the cylinder, including means for determining a misregistration of said cylinder relative to another cylinder, and means responsive to the misregistration determining means for modifying the reference printing image to the subsequent printing image.

2. The system of claim 1 including means for determining the speed of the press, and means responsive to the speed determining means for modifying the reference printing image to the subsequent printing image.

3. The system of claim 1 including a web being printed by the press, and including means responsive to the characteristics of the web of the press for modifying the reference printing image to the subsequent printing image.

4. The system of claim 1 including means for determining the tension of a web of the press, and means responsive to the tension determining means for modifying the reference printing image to the subsequent printing image.

5. The system of claim 1 including means responsive to the type of ink utilized on the press for modifying the reference printing image to the subsequent printing image.

6. The system of claim 1 including means for determining the ink density for the cylinder, and means responsive to the density determining means for modifying the reference printing image to the subsequent printing image.

7. The system of claim 1 including means for determining the dot gain in the image, and means responsive to the gain determining means for modifying the reference image to the subsequent image.

8. A control system for a printing press, comprising:
a printing cylinder having an outer surface;
means for determining at least one parameter for an image on the outer surface of the cylinder; and
means responsive to the determining means for directly forming a printing image on the outer surface of the cylinder, wherein the parameters are selected from the group consisting of ambient temperature, ambient humidity, type of ink, and type of substrate.

9. A control system for a printing press, comprising:
a printing cylinder having an outer surface;
means for determining a fan-out condition of a web in the press; and
means responsive to the determining means for forming a printing image directly on the outer surface of the cylinder.

10. A control system for a printing press, comprising:
a printing cylinder having an outer surface;
means for determining a reference printing image for the cylinder;
means for modifying the reference printing image to a subsequent printing image dependent upon parameters associated with the press; and
means for forming the subsequent printing image on the outer surface of the cylinder, including means responsive to the ambient conditions of the atmosphere adjacent the press for modifying the reference printing image to the subsequent printing image.

11. The system of claim 10 wherein the ambient conditions comprise the humidity and temperature of the atmosphere adjacent to the press.

12. A control system for a printing press, comprising:
a printing cylinder having an outer surface;
means for determining a reference printing image for the cylinder;
means for modifying the reference image to a subsequent printing image dependent upon parameters associated with the press; and
means for forming the subsequent printing image on the outer surface of the cylinder, including means responsive to the fanout of a web in the press for modifying the reference printing image to the subsequent printing image.

13. A control system for a printing press, comprising:
a printing cylinder having an outer surface;
means for determining a reference printing image for the cylinder;
means for modifying the reference image to a subsequent printing image dependent upon parameters associated with the press; and
means for forming the subsequent printing image on the outer surface of the cylinder, including means for determining the water density for the cylinder, and means responsive to the density determining means for modifying the reference printing image to the subsequent printing image.

* * * * *